US009610471B1

(12) United States Patent
Langlois

(10) Patent No.: US 9,610,471 B1
(45) Date of Patent: Apr. 4, 2017

(54) BELT RESISTANCE BAND

(71) Applicant: Larry Langlois, Houston, TX (US)

(72) Inventor: Larry Langlois, Houston, TX (US)

( * ) Notice: Subject to any disclaimer, the term of this patent is extended or adjusted under 35 U.S.C. 154(b) by 0 days.

(21) Appl. No.: 14/923,558

(22) Filed: Oct. 27, 2015

Related U.S. Application Data

(60) Provisional application No. 62/083,523, filed on Nov. 24, 2014.

(51) Int. Cl.
*A63B 21/02* (2006.01)
*A63B 21/055* (2006.01)
*A63B 21/00* (2006.01)

(52) U.S. Cl.
CPC ..... *A63B 21/0552* (2013.01); *A63B 21/4009* (2015.10); *A63B 21/4013* (2015.10); *A63B 21/4021* (2015.10); *A63B 21/4025* (2015.10)

(58) Field of Classification Search
USPC ..... 482/1–148
See application file for complete search history.

(56) References Cited

U.S. PATENT DOCUMENTS 5,306,222 A * 4/1994 Wilkinson ..... A41D 13/0015 482/121
5,720,042 A * 2/1998 Wilkinson ..... A41D 13/0015 2/69
5,820,533 A * 10/1998 Goldman ..... A63B 21/0552 482/124
5,993,362 A * 11/1999 Ghobadi ..... A63B 21/0004 482/121
5,996,871 A * 12/1999 Maeng ..... A63B 55/408 206/315.3
6,095,936 A * 8/2000 Kirkpatrick ..... A63B 69/0059 434/248
7,608,026 B1 * 10/2009 Nicassio ..... A63B 21/00185 24/265 BC
9,061,173 B1 * 6/2015 Felkel ..... A63B 21/0557
9,138,608 B2 * 9/2015 Medina ..... A63B 21/065
2005/0227833 A1 * 10/2005 Wilkinson ..... A63B 21/0004 482/124
2005/0261113 A1 * 11/2005 Wilkinson ..... A63B 21/0004 482/124
2006/0176681 A1 * 8/2006 Krimmer ..... A63B 69/0028 362/108
2007/0010380 A1 * 1/2007 Wilkinson ..... A63B 21/0004 482/124
2014/0315699 A1 * 10/2014 Winbush ..... A63B 69/0028 482/139

* cited by examiner

*Primary Examiner* — Stephen Crow

(57) ABSTRACT

The belt resistance band is a device that is worn on an end user in order to conduct a plurality of stretches or exercises at the discretion of the end user. The end user is able to wear the belt resistance band while standing or sitting. Moreover, the end user is able to stretch or exercise the arms or the legs of the end user regardless of whether the end user is standing or sitting.

9 Claims, 8 Drawing Sheets

BELT RESISTANCE BAND

CROSS REFERENCES TO RELATED APPLICATIONS

This non-provisional patent application claims priority to provisional patent application 62/083,523, which was filed on Nov. 24, 2014.

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates generally to a device that is a belt (and the top of a harness) as the main source or connection point for different exercise bands used for stretching and getting a workout. A person will be able to workout from a standing position, or while confined to a wheelchair, or when taking a short break during the workday, or when lying down in a prone or supine position.

SUMMARY OF THE INVENTION

The unique features of this product will provide the following benefits to all consumers everywhere: a convenient way for many to do various kinds of strengthening exercises, especially those who must exercise from a seated position; couch potatoes and workers who spend many hours at a desk, can have short intervals of exercising without having to go outside or visit a gym; may replace weights, barbells, and other equipment that clutter one's home; could be used in gyms, rehabilitation and sports training facilities; The utility belt connected to wrist and ankle bands with resistance bands can be used in combination with other pieces to enhance one's workout; can be used to provide a more total and complete workout, especially for those with physical limitations.

These together with additional objects, features and advantages of the belt resistance band will be readily apparent to those of ordinary skill in the art upon reading the following detailed description of the presently preferred, but nonetheless illustrative, embodiments when taken in conjunction with the accompanying drawings.

In this respect, before explaining the current embodiments of the belt resistance band in detail, it is to be understood that the belt resistance band is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the belt resistance band.

It is therefore important that the claims be regarded as including such equivalent construction insofar as they do not depart from the spirit and scope of the belt resistance band. It is also to be understood that the phraseology and terminology employed herein are for purposes of description and should not be regarded as limiting.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DETAILED DESCRIPTION OF THE EMBODIMENT

Figure 1:
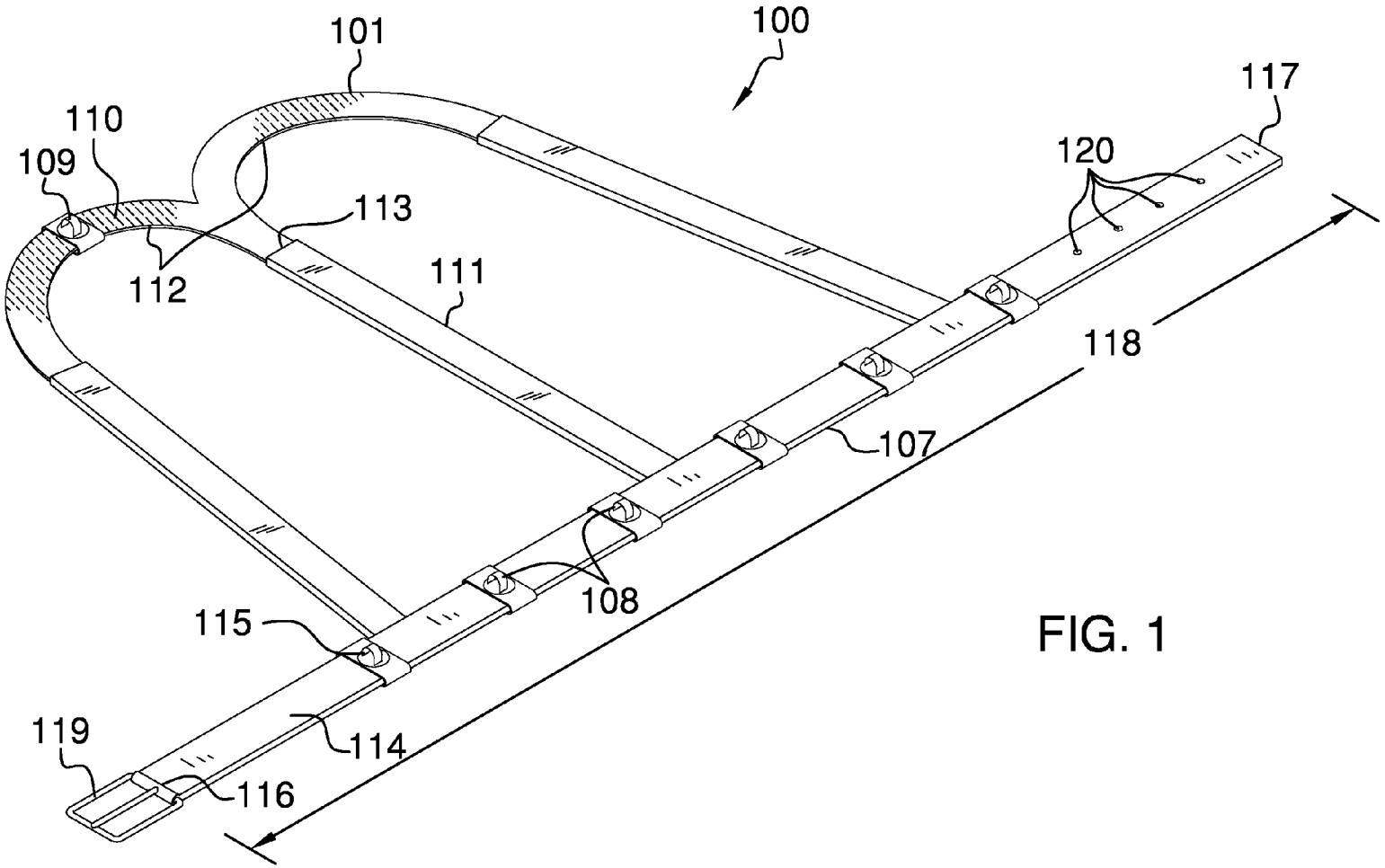
FIG. 1 is a first perspective view of an embodiment of the disclosure by itself.
Figure 2:
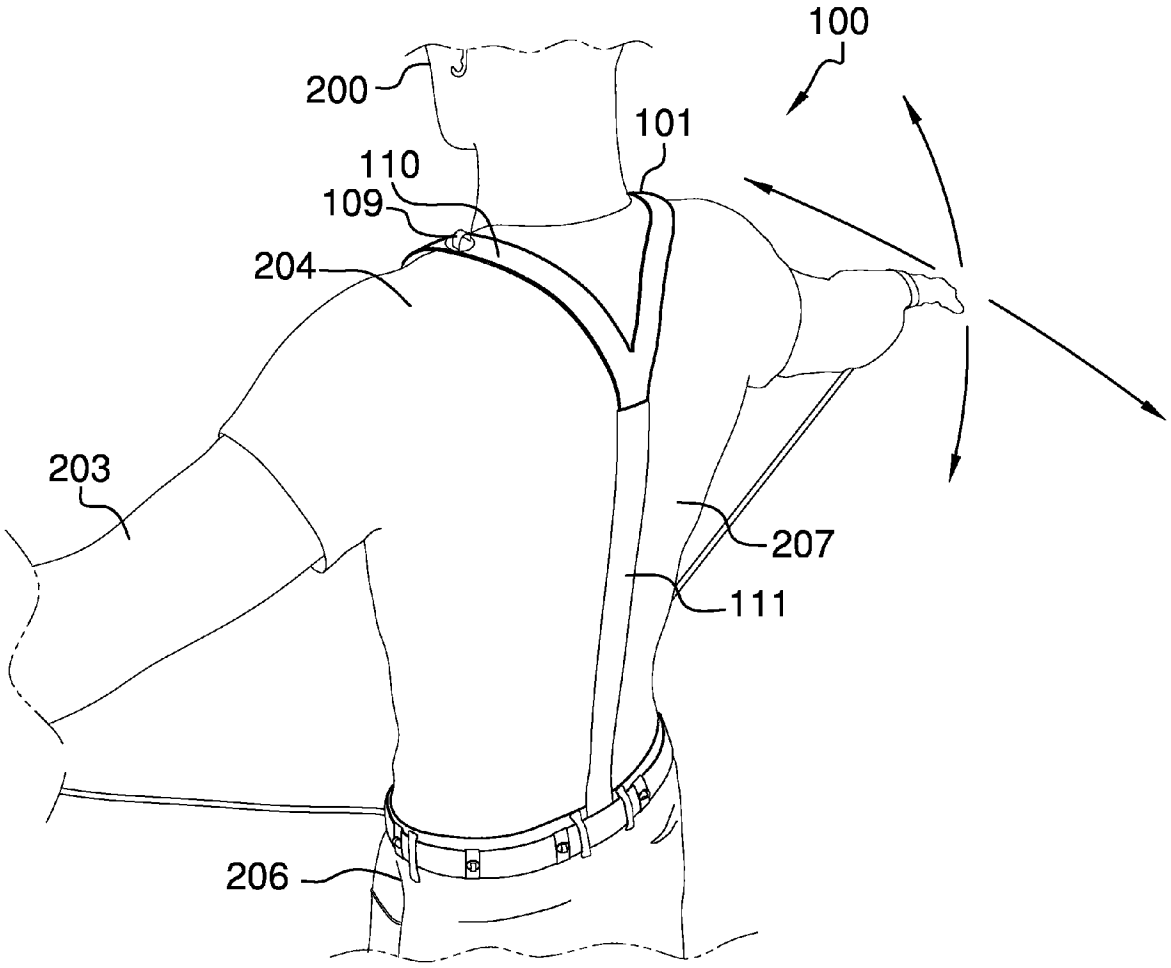
FIG. 2 is second, perspective view of an embodiment of the disclosure in use.
Figure 3:
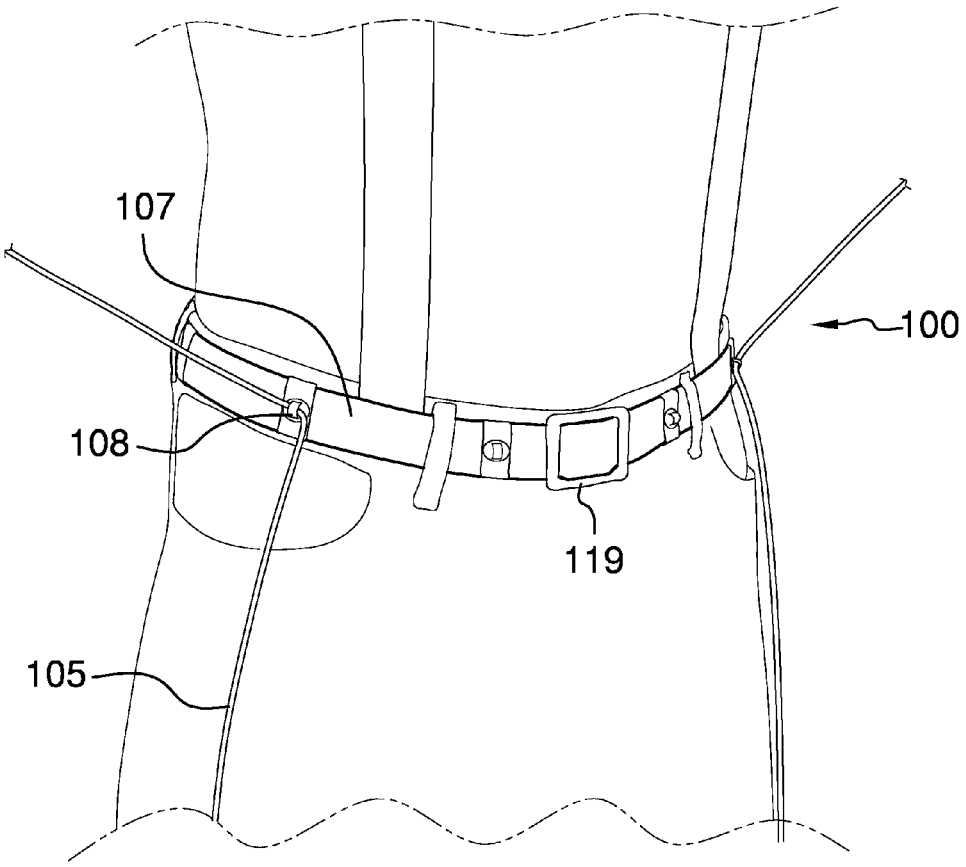
FIG. 3 is a third, perspective view of an embodiment of the disclosure in use.
Figure 4A:
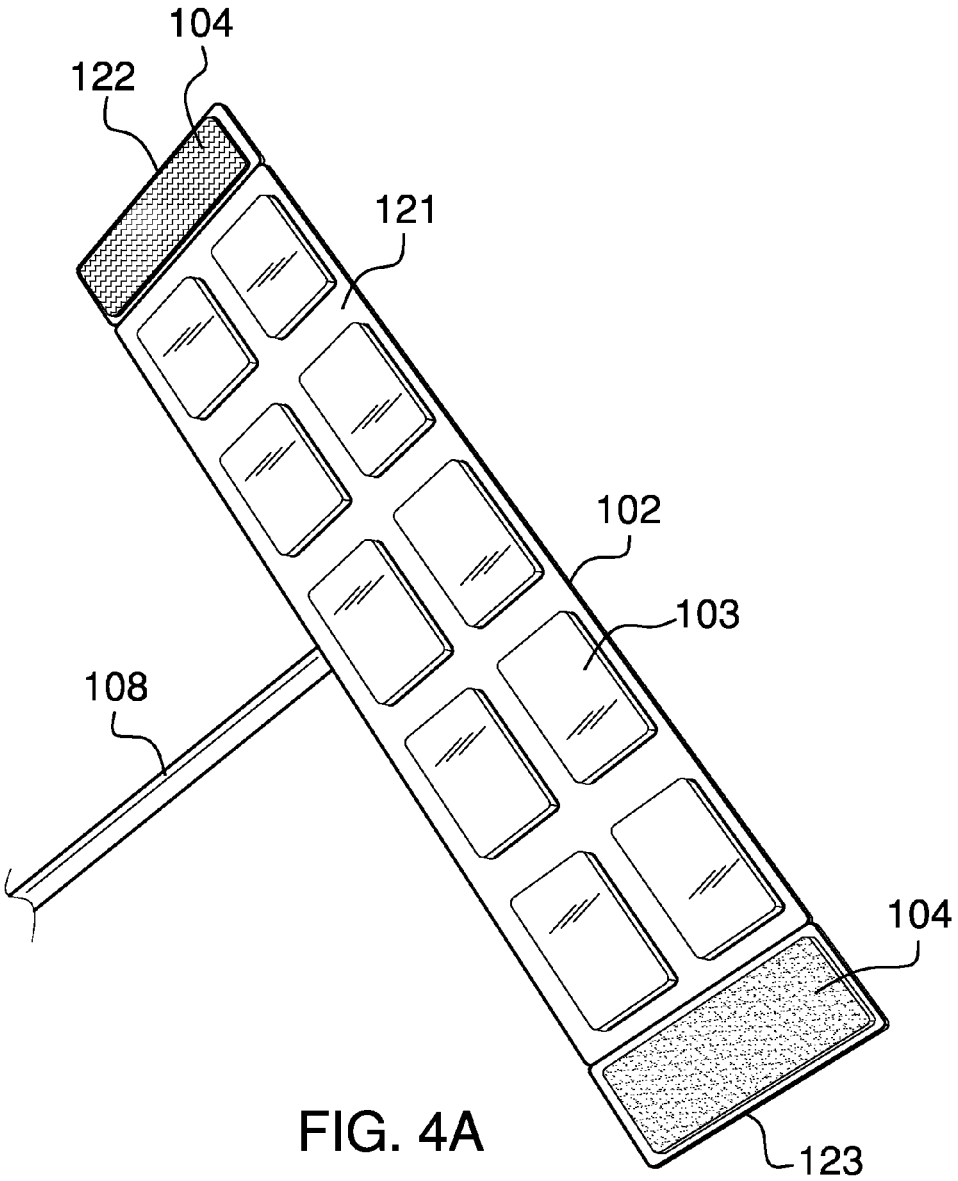
FIG. 4A is a perspective, detail view of an embodiment of the disclosure.
Figure 4B:
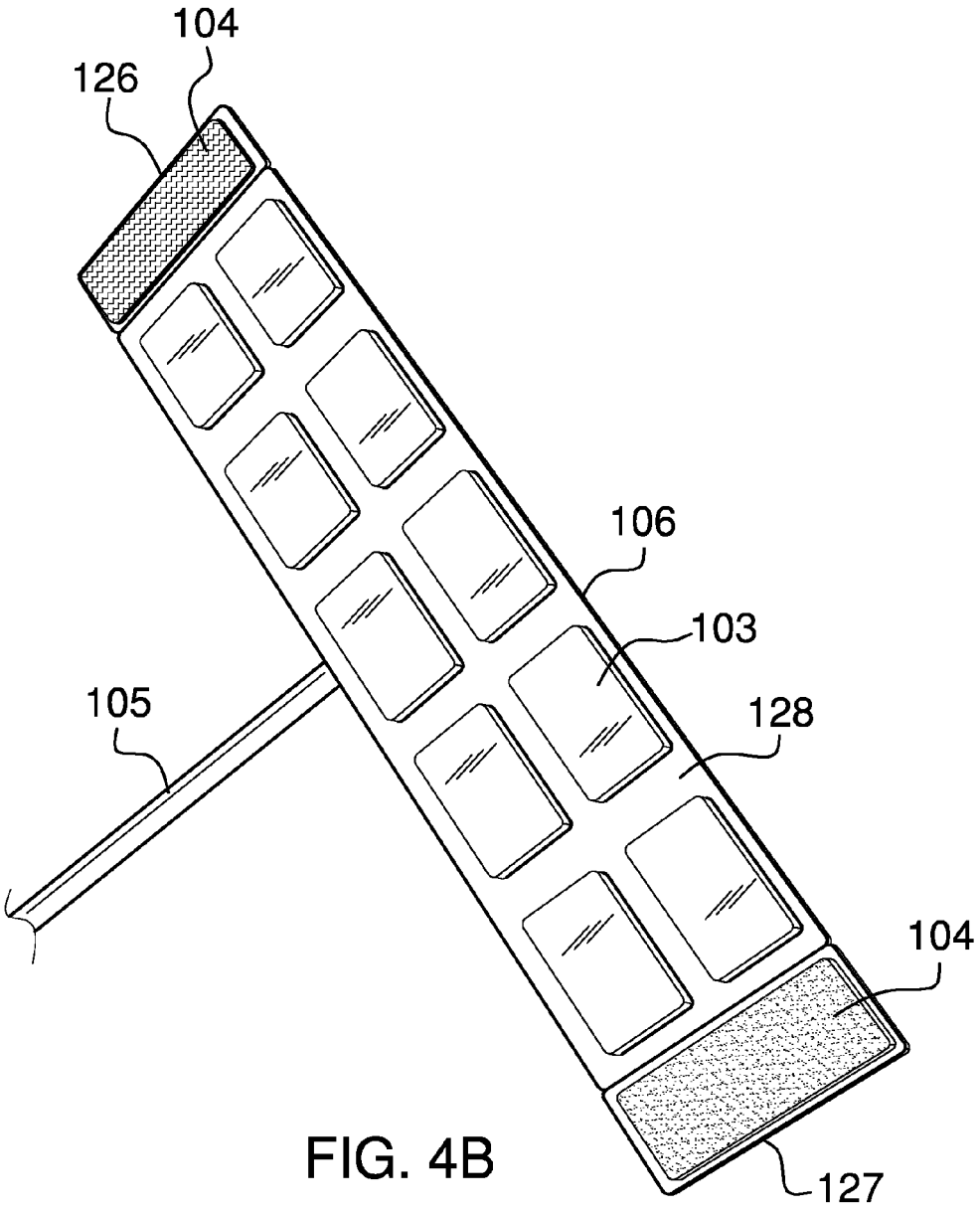
FIG. 4B is a perspective, detail view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to a first potential embodiment of the disclosure, which is illustrated in FIGS. 1 through 6. The belt resistance band 100 (hereinafter invention) comprises at least one shoulder strap 101, at least one wrist band 102, padding 103, a nylon hook and loop strip 104, at least one resistance band 105, at least one ankle band 106, a belt 107, and a plurality of resistance loops 108. The invention 100 is designed to provide a convenient way for men and women of all ages to do stretching and stretching and strengthening exercises.

The invention 100 works in concert with the at least one wrist band 102 and the at least one ankle band 106 to adaptively engage a wrist 201 and an ankle 202 of an end user 200. Moreover, the at least one wrist band 102 and the at least one ankle band 106 are connected with the at least one resistant band 105 to provide a more total and complete workout for every user, even those with physical limitations and handicaps.

The at least one shoulder strap 101 provides another place to connect the at least one resistance band 105. The same bands can be used around the ankles or the wrists. These bands are comprised of padding for comfort and adjustable in size with a nylon hook and loop strip 104. They can be connected to front, side, and back loops on the belt 107 for doing various exercises. In addition, the at least one shoulder strap 101 has at least one shoulder loop 109 at a topmost portion 110 of the at least one shoulder strap 101, providing an additional place to connect or loop the at least one resistance band 105 thereto for doing other range-of-motion exercises for arms 203 of the end user 200 (see FIG. 6). It shall be noted that the at least one shoulder strap 101 is adapted to be draped over a shoulder 204 of the end user 200.

The at least one resistance band 105 can be connected between the ankles and the shoulders for doing leg lifts and curls. All major exercises come from and are controlled from the belt 107 so those with mobility limitations can still do a wide array of exercises. The use, limits, techniques and variety of exercises done will be determined by the user's physical condition and their imaginations. Hand handles, foot gears, ankle bands, wrist bands, elbow bands/pads, knee bands/pads can all be used in various configurations for doing a wide variety of beneficial exercises.

The at least one shoulder strap 101 is further defined with an elongated strap member 111 that is adapted to extend from a user's waist 206 going along a back 207 of the end user 200. The at least one shoulder strap 101 may be a pair of shoulder straps 112 that branch out from a topmost end 113 of the elongated strap member 111, and are adapted to each extend over the shoulder 204 of the end user 200. The at least one shoulder strap 101 is adjustable in order to fit the dimension of any end user 200.

The belt 107 is further defined with the plurality of resistance loops 108 that are provided on an outer belt surface 114. Each of the plurality of resistance loops 108 is further defined to include a small circular object 115 that provides the security and resistance strength to the invention 100 as the end user 200 would like. The belt 107 is further defined with a first belt end 116 and a second belt end 117. The belt 107 is further defined with a belt length 118 that extends between the first belt end 116 and the second belt end 117. The first belt end 116 includes a belt buckle 119 that is able to secure to one of a plurality of belt holes 120 provided adjacent the second belt end 117.

The at least one wrist band 102 is further defined to include the padding 103. Moreover, the padding 103 is provided on an inner wrist band surface 121 of the at least one wrist band 102. The padding 103 is a rectangular shaped object with rounded corners that provide the comfort and security to the at least one wrist band 102 for the end user 200. The at least one wrist band 102 is further defined with the nylon hook and loop strips 104 that are also provided on the inner wrist band surface 121. The nylon hook and loop strips 104 are rectangular shaped objects located adjacent a first wrist end 122 and a second wrist end 123 of the at least one wrist band 102. The nylon hook and loop strips 104 provide the security of the at least one wrist band 102 from adaptively falling off of the wrist 201 of the end user 200.

The at least one ankle band 106 is a rectangular object that is able to manipulate itself to adaptively wrap itself around the ankle 202 of the end user 200. The at least one ankle band 106 is further defined to include the same structure as the at least one wrist band 102. Moreover, the at least one ankle band 106 is further defined to include the padding 103 and the nylon hook and loop strips 104. The padding 103 is a rectangular shaped object with rounded corners that provide the comfort and security for the end user 200. The at least one ankle band 106 is further defined to include the nylon hook and loop strips 104. The nylon hook and loop strips 104 is further defined as a rectangular shaped object located at a first ankle end 126 and a second ankle end 127 of the at least one ankle band 106. The padding 103 and the nylon hook and loop strip 104 are provided on an inner ankle surface 128 of the at least one ankle band 106.

The padding 103 of the at least one ankle pad 106 may be referred to as ankle padding 103. Moreover, the padding 103 of the at least one wrist pad 102 may be referred to as wrist padding 103.

Figure 5A:
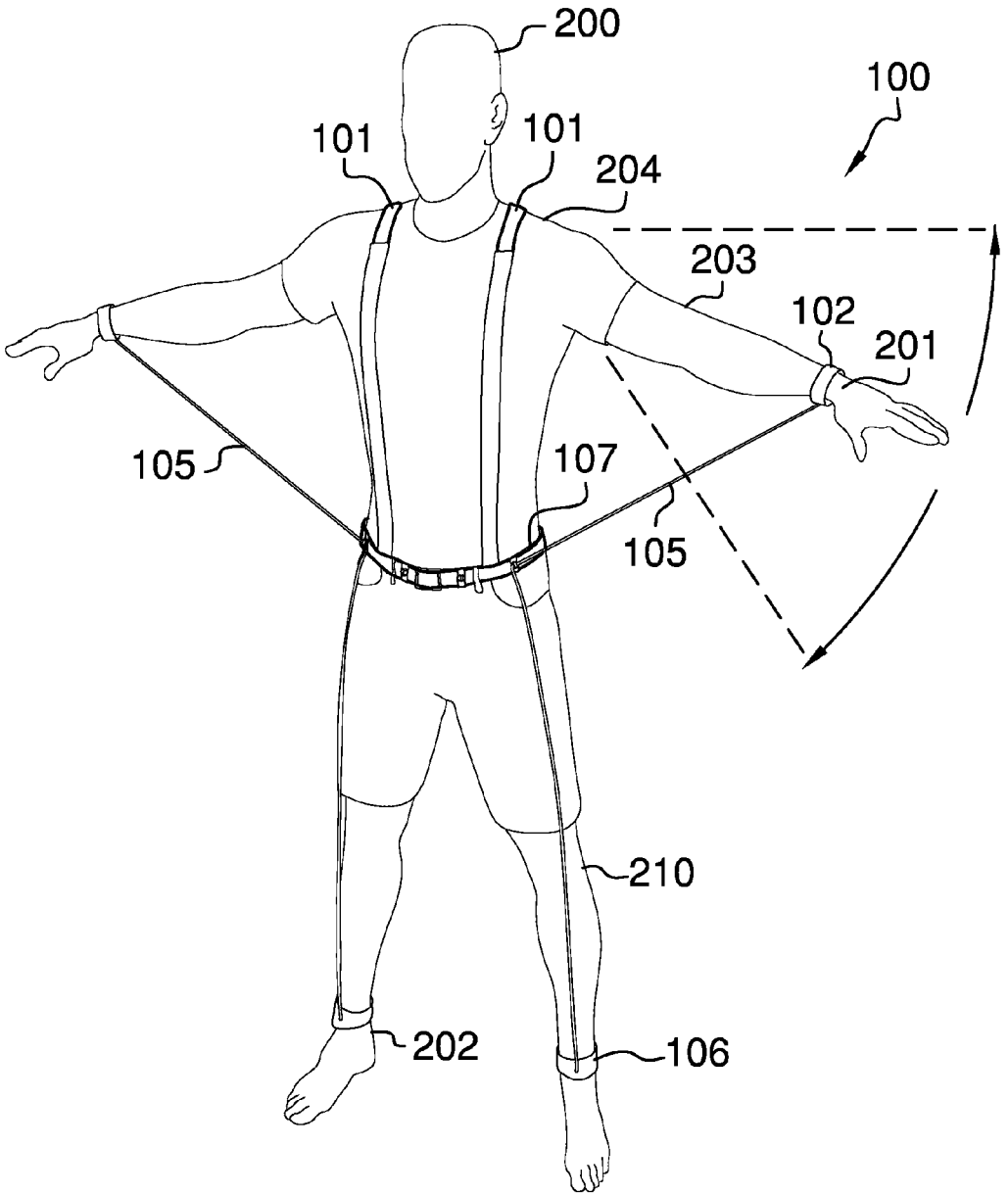
FIG. 5A is a perspective view of an embodiment of the disclosure in use.
Figure 5B:
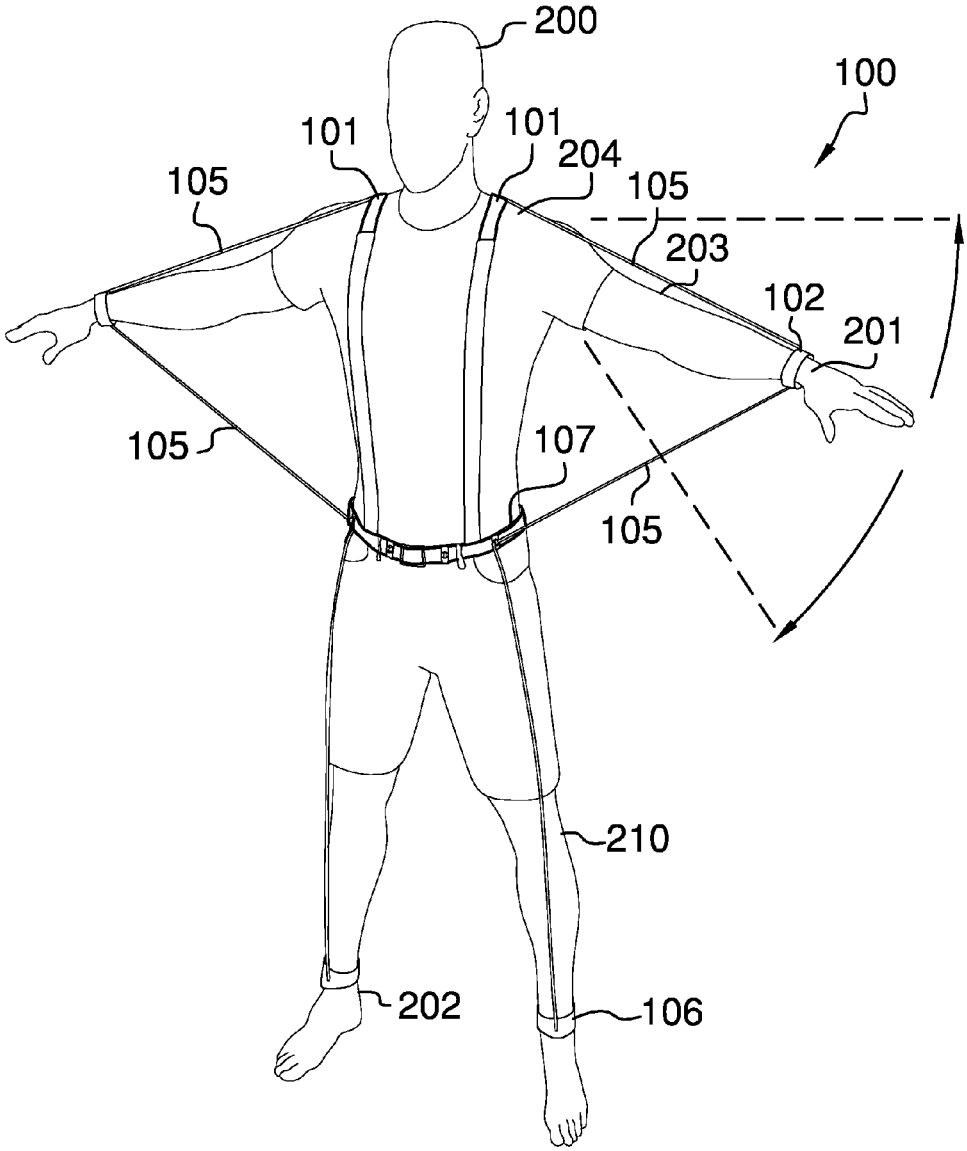
FIG. 5B is a perspective view of another embodiment of the disclosure in use.
Figure 6:
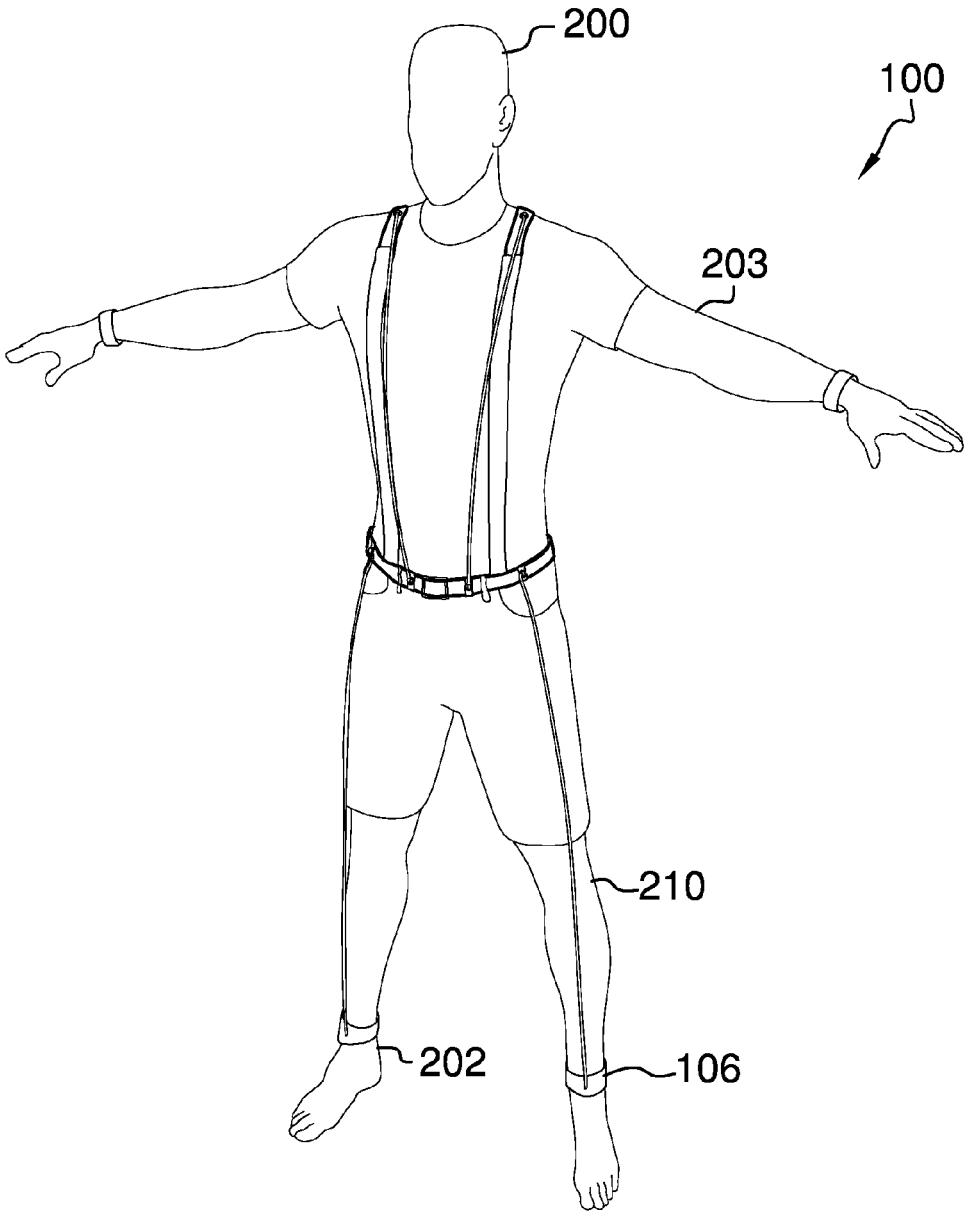
FIG. 6 is another perspective view of an embodiment of the disclosure in use.

In use, the invention 100 is adapted to be worn on the end user 200 such that the end user 200 is able to perform a plurality of stretching exercises. The at least one resistance band 105 is looped through one of the plurality of hoops 108 provided on the belt 107 in order to provide different levels of resistance when stretching legs 210 or the arms 203 of the end user 200. The invention 100 is able to be worn via the end user 200 in a plurality of scenarios. More specifically, the end user 200 may be standing (see FIGS. 5A and 5B) or sitting (see FIG. 2) in order to utilize the invention 100 to stretch the legs 210 or the arms 203 or both. Referring to FIG. 5B, the at least one resistance band 105 may be able to traverse from the shoulder strap 101 over to a correspond wrist strap 102, and in conjunction with traversing of the at least one resistance band 105 from the wrist strap 102 to the belt 107 before descending down to the at least one ankle pad 106.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A resistance band device comprising:

a belt that is adapted to be worn via a user;

wherein at least one ankle strap is adapted to be worn on the ankle of the user;

wherein at least one wrist strap is adapted to be worn on the wrist of the user;

wherein at least one shoulder strap attaches to the belt and is adapted to extend over the shoulder of the user;

wherein at least one resistance band is attached to the belt and the at least one ankle strap or the at least one wrist strap such that the user is able to stretch or exercise muscles associated with the leg or arm of the user;

wherein the belt includes a plurality of loops that are selected to engage the at least one resistance band in order provide varying levels of resistance for the user;

wherein the at least one shoulder strap has at least one shoulder loop at a topmost portion of the at least one shoulder strap, providing an additional place to connect or loop the at least one resistance band thereto for doing other range-of-motion exercises for arms of the user;

wherein the at least one shoulder strap is adapted to be draped over a shoulder of the user;

wherein the at least one shoulder strap is further defined with an elongated strap member that is adapted to extend from a user's waist going along a back of the user;

wherein the at least one shoulder strap is further defined as a pair of shoulder straps that branch out from a topmost end of the elongated strap member, and are adapted to each extend over the shoulder of the user;

wherein the belt is further defined with the plurality of loops that are provided on an outer belt surface;

wherein each of the plurality of loops is further defined to include a small circular object that provides the security and resistance strength onto the at least one resistance band;

wherein the belt is further defined with a first belt end and a second belt end;

wherein the belt is further defined with a belt length that extends between the first belt end and the second belt end;

wherein the first belt end includes a belt buckle that is able to secure to one of a plurality of belt holes provided adjacent the second belt end;

wherein the at least one wrist band is further defined to include a wrist padding.

2. The resistance band device according to claim 1 wherein the wrist padding is provided on an inner wrist band surface of the at least one wrist band; wherein the wrist padding is a rectangular shaped object with rounded corners that provide the comfort and security to the at least one wrist band for the user.

3. The resistance band device according to claim 2 wherein the at least one wrist band is further defined with nylon hook and loop strips that are also provided on the inner wrist band surface.

4. The resistance band device according to claim 3 wherein the nylon hook and loop strips are rectangular shaped objects located adjacent a first wrist end and a second wrist end of the at least one wrist band; wherein the nylon hook and loop strips provide the security of the at least one wrist band from adaptively falling off of the wrist of the user.

5. The resistance band device according to claim 4 wherein the at least one ankle band is a rectangular object that is able to manipulate itself to adaptively wrap itself around the ankle of the user.

6. The resistance band device according to claim 5 wherein the at least one ankle band is further defined to include an ankle padding and the nylon hook and loop strips; wherein the ankle padding is a rectangular shaped object with rounded corners that provide the comfort and security for the user.

7. The resistance band device according to claim 6 wherein the at least one ankle band is further defined to include the nylon hook and loop strips; wherein the nylon hook and loop strips is further defined as a rectangular shaped object located at a first ankle end and a second ankle end of the at least one ankle band.

8. The resistance band device according to claim 7 wherein the ankle padding and the nylon hook and loop strip are provided on an inner ankle surface of the at least one ankle band.

9. The resistance band device according to claim 8 wherein the at least one resistance band traverses from the shoulder strap over to a corresponding one of the at least one wrist strap, and in conjunction with traversing of the at least one resistance band from the at least one wrist strap to the belt before descending down to the at least one ankle pad.

* * * * *